US008250949B2

(12) United States Patent
Hu

(10) Patent No.: US 8,250,949 B2
(45) Date of Patent: Aug. 28, 2012

(54) TOOL ASSEMBLY WITH COAXIAL/UNIVERSAL COUPLING

(76) Inventor: Bobby Hu, Taichung (TW)

( * ) Notice: Subject to any disclaimer, the term of this patent is extended or adjusted under 35 U.S.C. 154(b) by 332 days.

(21) Appl. No.: 12/758,854

(22) Filed: Apr. 13, 2010

(65) Prior Publication Data

US 2010/0294092 A1 Nov. 25, 2010

(30) Foreign Application Priority Data

May 19, 2009 (TW) ..... 98116613 A
May 19, 2009 (TW) ..... 98116614 A

(51) Int. Cl.
*B25B 23/16* (2006.01)
*B25B 13/06* (2006.01)

(52) U.S. Cl. ..... 81/177.75; 81/177.85

(58) Field of Classification Search ..... 81/177.75, 81/177.2, 177.6, 177.7, 177.85
See application file for complete search history.

(56) References Cited

U.S. PATENT DOCUMENTS 7,278,342 B1 10/2007 Chang ..... 81/177.75
7,481,136 B2 * 1/2009 Chiang ..... 81/177.75
7,942,426 B2 * 5/2011 Peters ..... 279/143
2009/0288523 A1 * 11/2009 Chen ..... 81/177.85

* cited by examiner

*Primary Examiner* — David B Thomas
(74) *Attorney, Agent, or Firm* — Alan Kamrath; Kamrath IP Lawfirm, PA

(57) ABSTRACT

A tool assembly includes a body having a receptacle. An adapter includes a shoulder, a head, and a neck interconnecting the head and the shoulder. The head engages with an inner periphery of the receptacle, allowing joint rotation of the adapter and the body. The head is slideably received in the receptacle between first and second positions. A C-clip is received in a retaining groove in the inner periphery of the receptacle. When the head is in the first position, the shoulder is received in the receptacle, the C-clip distends and clamps the shoulder to keep the adapter to be coaxial to the body. When the head is in the second position, the shoulder is outside of the receptacle, the C-clip abuts an outer periphery of the head, and the head is rotatable to a position such that the adapter is at an angle to the body.

20 Claims, 23 Drawing Sheets

TOOL ASSEMBLY WITH COAXIAL/UNIVERSAL COUPLING

BACKGROUND OF THE INVENTION

The present invention relates to a tool assembly with coaxial/universal coupling and, more particularly, to a tool assembly selectively providing coaxial or universal coupling by utilizing one or two C-clips.

A type of tool assembly allowing coaxial/universal coupling includes a tool mount having a hole in an end thereof. A tool shank includes an end having a rounded engaging member received in the hole. A C-clip is mounted in the hole to retain the engaging member in the hole. The other end of the tool mount can receive a bit or engage with a driving device. The other end of the tool shank can engage with a driving device or a socket. The hole of the tool mount includes a plurality of flat surfaces each having a recess. The engaging member includes a receptacle receiving a ball and a spring biasing the ball to engage with one of the recesses, positioning the engaging member in the hole while the tool mount is coaxial to the tool shank. The tool shank can be moved away from the tool mount to disengage the ball from the recess and then pivoted to a position at a desired acute angle to the tool mount. Thus, the tool mount can be coaxial or at the desired acute angle to the tool shank while allowing joint rotation of the tool mount and the tool shank regardless of the angular relationship therebetween. An example of such a tool assembly is disclosed in U.S. Pat. No. 7,278,342. However, formation of the receptacle and recesses and mounting of the ball and the spring in the engaging member of the tool shank are time-consuming and increase the manufacturing costs. Furthermore, the engagement of the ball and spring in one of the recesses provides only one biasing point to maintain the position of the engaging member in the hole. The resulting positioning effect is unreliable.

Thus, a need exists for an inexpensive, simple tool assembly with coaxial/universal coupling. There is also a need for such a tool assembly with multiple contact points to maintain the coaxial position.

BRIEF SUMMARY OF THE INVENTION

The present invention solves this need and other problems in the field of tool assemblies allowing coaxial/universal coupling by providing, in a preferred form, a tool assembly including a body having first and second ends spaced along a longitudinal axis of the body. The first end of the body includes a sleeve portion having a receptacle with an opening in an end face of the first end. The receptacle has non-circular cross sections perpendicular to the longitudinal axis of the body. The receptacle further includes an inner periphery having an annular retaining groove adjacent the opening of the receptacle. An adapter includes first and second ends spaced along a longitudinal axis of the adapter. A shoulder is formed on the first end of the adapter and has an outer periphery. The first end of the adapter further includes a head and a neck. The neck interconnects and is intermediate the head and the shoulder along the longitudinal axis of the adapter. The head has non-circular cross sections perpendicular to the longitudinal axis of the adapter. The head engages with the inner periphery of the receptacle to allow joint rotation of the adapter and the body. The head is slideably received in the receptacle of the sleeve portion along the longitudinal axis of the body between first and second positions. A C-clip is received in the retaining groove of the sleeve portion. The C-clip prevents the head from disengaging from the receptacle.

When the head is in the first position, the shoulder is received in the receptacle of the sleeve portion, the C-clip distends and clamps the outer periphery of the shoulder to keep the longitudinal axis of the adapter to be coaxial to the longitudinal axis of the body.

When the head is in the second position, the shoulder is outside of the receptacle of the sleeve portion, and the C-clip abuts an outer periphery of the head. Furthermore, the head is rotatable relative to the longitudinal axis of the body to a position such that the longitudinal axis of the adapter is at an angle to the longitudinal axis of the body.

In preferred forms, the inner periphery of the receptacle further includes an annular second retaining groove. The first retaining groove is intermediate the second retaining groove and the opening of the receptacle along the longitudinal axis of the body. A second C-clip is received in the second retaining groove of the sleeve portion. When the head is in the first position, the second C-clip distends and clamps an outer periphery of the head to keep the longitudinal axis of the adapter to be coaxial to the longitudinal axis of the body. When the head is in the second position, the head is disengaged from the second C-clip.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
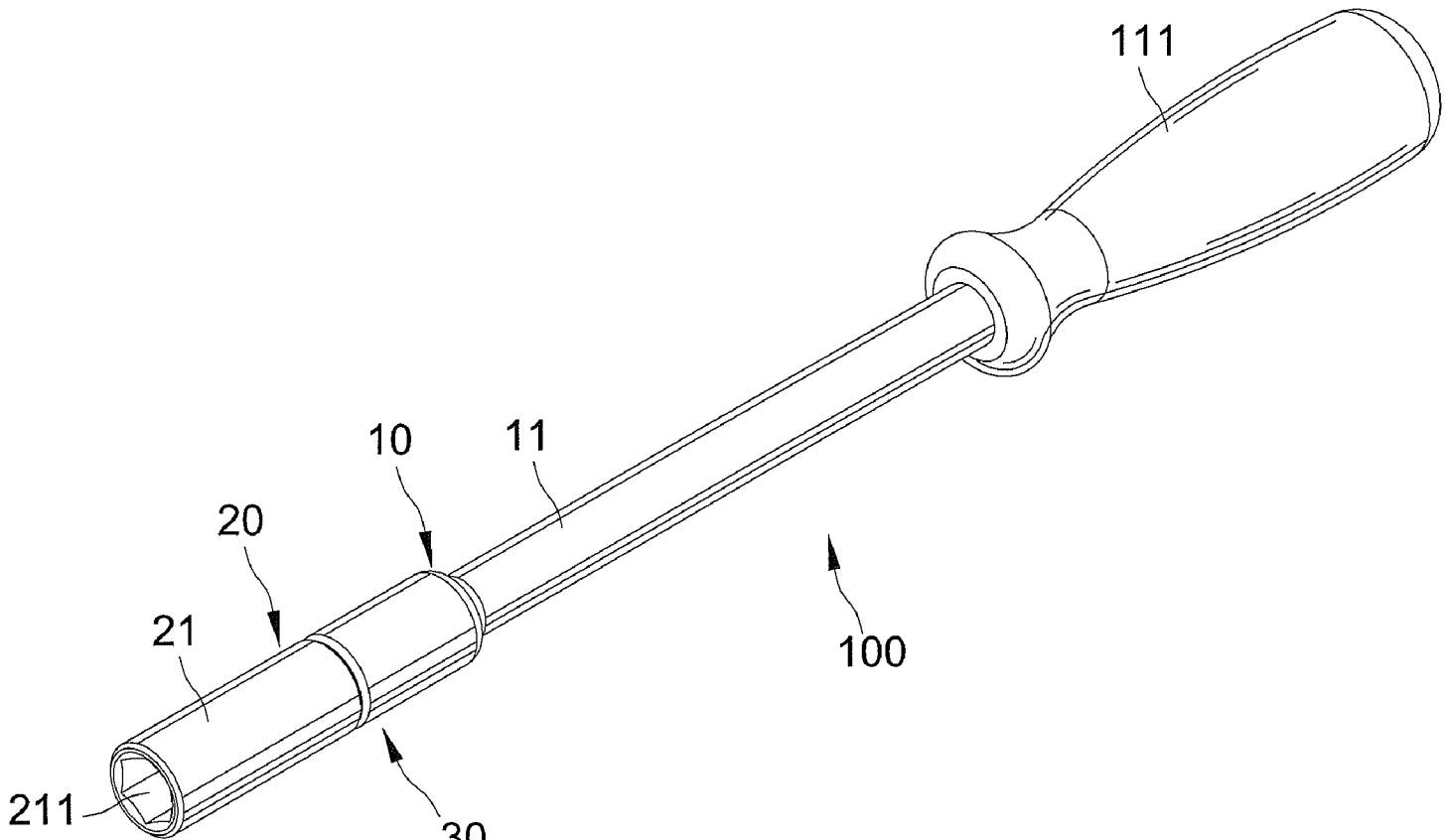
FIG. 1 shows a perspective view of a first example of a tool assembly of a first embodiment according to the preferred teachings of the present invention.
Figure 2:
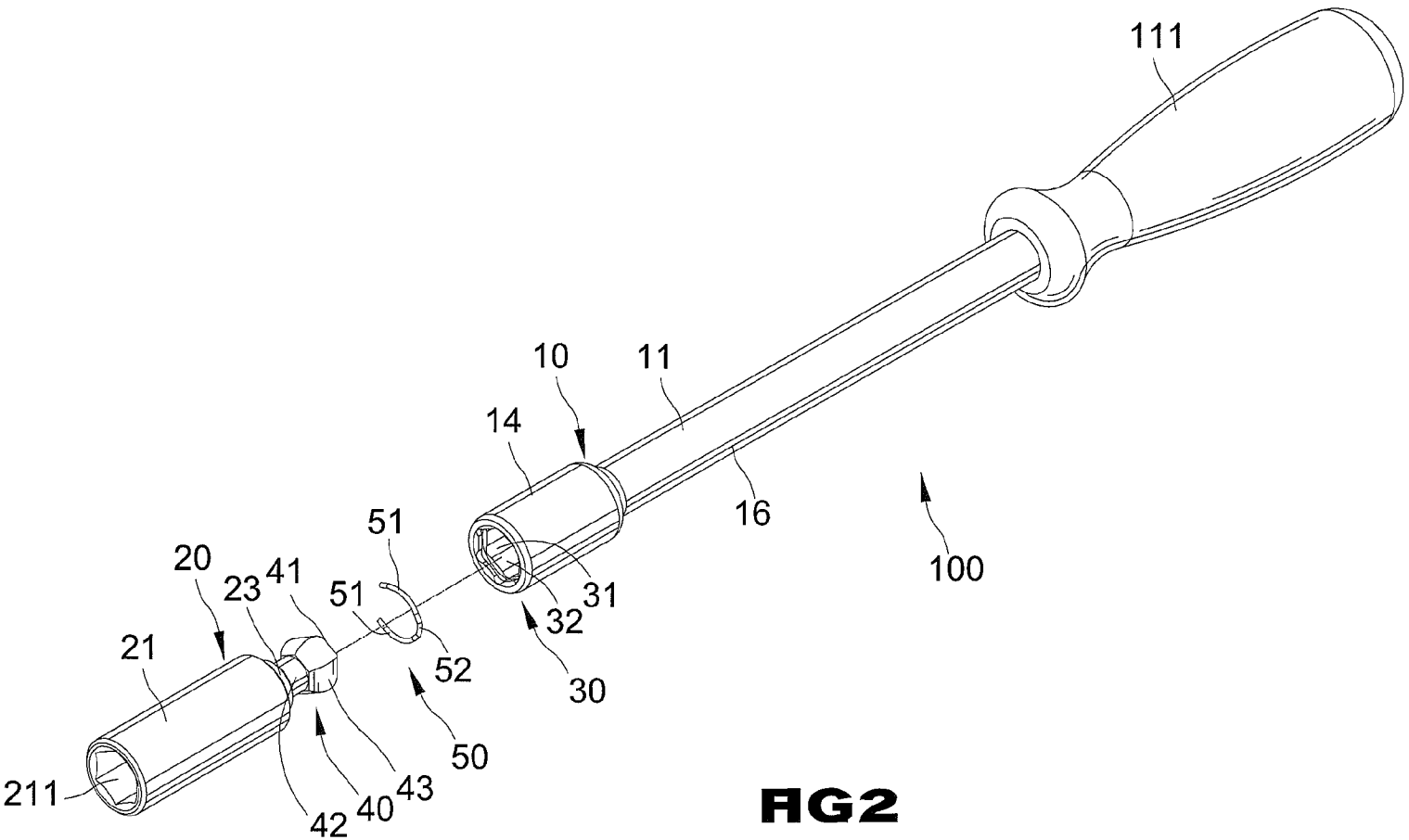
FIG. 2 shows an exploded, perspective view of the tool assembly of FIG. 1.
Figure 3:
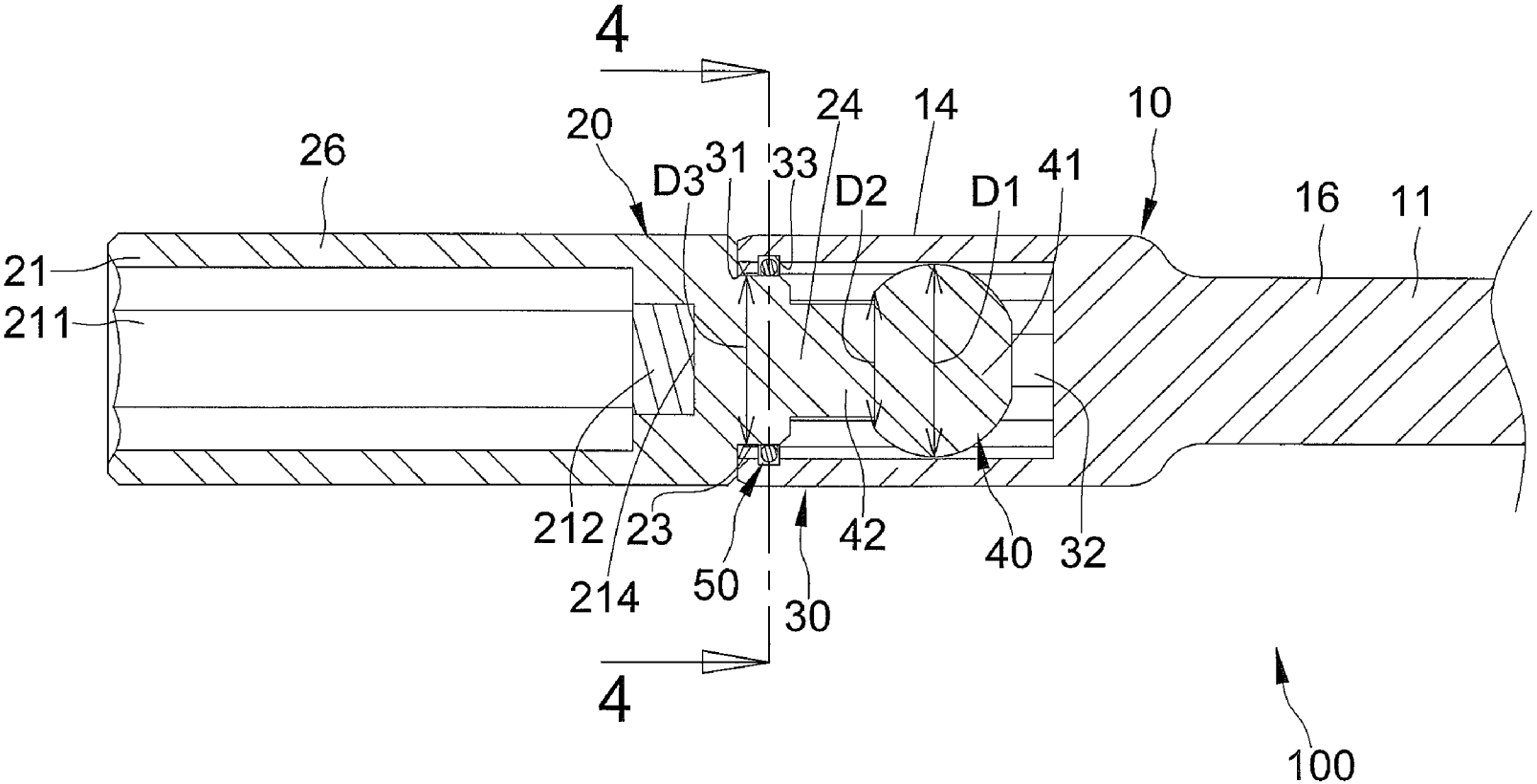
FIG. 3 shows a partial, cross sectional view of the tool assembly of FIG. 1 with an adapter coaxial to a body of the tool assembly.
Figure 4:
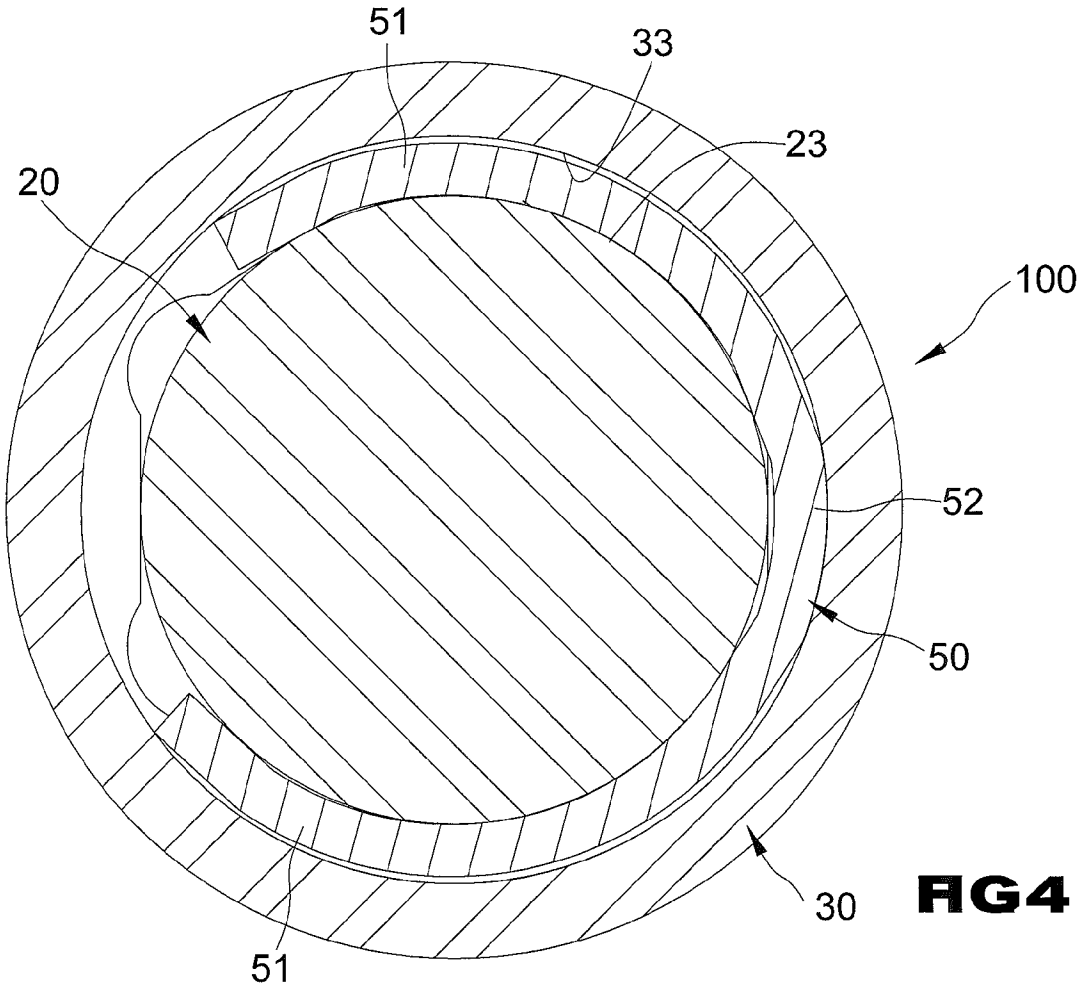
FIG. 4 shows a cross sectional view of the tool assembly of FIG. 1 according to section line 4-4 of FIG. 3.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "outer", "end", "portion", "section", "longitudinal", "annular", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A tool assembly according to the preferred teachings of the present invention is shown in the drawings and generally designated 100, wherein FIGS. 1-13 show tool assembly 100 of a first embodiment according to the preferred teachings of the present invention, and FIGS. 14-23 show tool assembly 100 of a second embodiment according to the preferred teachings of the present invention.

In preferred forms shown in FIGS. 1-23, tool assembly 100 includes a body 10, 10A having first and second ends 14 and 16 spaced along a longitudinal axis of body 10, 10A. First end 14 of body 10, 10A includes a sleeve portion 30 having a receptacle 31 with an opening in an end face of first end 14. Receptacle 31 has non-circular cross sections perpendicular to the longitudinal axis of body 10, 10A. In the preferred forms shown in FIGS. 1-23, receptacle 31 has hexagonal cross sections perpendicular to the longitudinal axis of body 10, 10A. An inner periphery of receptacle 31 includes a planar engaging surface 32.

In the preferred forms shown in FIGS. 1-23, the inner periphery of receptacle 31 further includes an annular first retaining groove 33 adjacent the opening of receptacle 31. In the preferred forms shown in FIGS. 14-23, the inner periphery of receptacle 31 further includes an annular second retaining groove 34 having a diameter perpendicular to the longitudinal axis of body 10, 10A and larger than the diameter of first retaining groove 33. First retaining groove 33 is intermediate second retaining groove 34 and the opening of receptacle 31 along the longitudinal axis of body 10, 10A.

In the preferred forms shown in FIGS. 1-9, 12-13, and 14-21, a shank 11 is formed on second end 16 of body 10 and includes a handgrip 111 on a distal end thereof. In the preferred forms shown in FIGS. 10-11 and 22-23, second end 16 of body 10A includes a driving section 12 having an engaging groove 121 for releasably receiving a bit or the like. Engaging groove 121 has an end wall with a receiving space 124 receiving a magnet 122 for attracting and retaining the bit in engaging groove 121. However, other forms of second end 16 of body 10, 10A for releasably coupling a driving device, a socket, a fastener, or the like can be utilized according to the teachings of the present invention.

In the preferred forms shown in FIGS. 1-23, tool assembly 100 further includes an adapter 20, 20A having first and second ends 24 and 26 spaced along a longitudinal axis of adapter 20, 20A. A shoulder 23 is formed on first end 24 of adapter 20, 20A. First end 24 of adapter 20, 20A further includes an engaging section 40 having a head 41 and a neck 42. Neck 42 interconnects and is intermediate head 41 and shoulder 23 along the longitudinal axis of adapter 20, 20A. Head 41 has non-circular cross sections perpendicular to the longitudinal axis of the adapter 20, 20A. In the preferred forms shown in FIGS. 1-23, head 41 has hexagonal cross sections perpendicular to the longitudinal axis of adapter 20, 20A. Head 41 includes an outer periphery having an arcuate or planar engaging face 43 aligned with planar engaging surface 32. Planar engaging surface 32 of sleeve portion 30 engages with engaging face 43 of head 41 to allow joint rotation of body 10, 10A and adapter 20, 20A. Thus, head 41 engages with the inner periphery of receptacle 31 to allow joint rotation of adapter 20, 20A and body 10, 10A. It can be appreciated that sleeve portion 30 can include more than one planar engaging surface 32, and head 41 can include a corresponding number of arcuate or planar engaging faces 43. Furthermore, head 41 is slideably received in receptacle 31 of sleeve portion 30 along the longitudinal axis of body 10, 10A between first and second positions.

In preferred forms shown in FIGS. 1-9, 12-13, and 14-21, second end 26 of adapter 20 includes a driving section 21 having an engaging groove 211 for releasably receiving a bit or the like. Engaging groove 211 has an end wall with a receiving space 214 receiving a magnet 212 for attracting and retaining the bit in engaging groove 211. In the preferred forms shown in FIGS. 10-11 and 22-23, a shank 22 is formed on second end 26 of adapter 20A and has a handgrip 221 on a distal end thereof. However, other forms of second end 26 of adapter 20, 20A for releasably coupling a driving device, a socket, a fastener, or the like can be utilized according to the teachings of the present invention.

In the preferred forms shown in FIGS. 1-23, head 41 has a maximum, first diameter D1 perpendicular to the longitudinal axis of adapter 20, 20A. Head 41 further has a second diameter D2 perpendicular to the longitudinal axis of adapter 20, 20A at an adjoining section contiguous to neck 42. Shoulder 23 has circular cross sections perpendicular to the longitudinal axis of adapter 20, 20A and has a third diameter D3 perpendicular to the longitudinal axis of adapter 20, 20A. First diameter D1 is larger than third diameter D3, which, in turn, is larger than second diameter D2. In the preferred form shown in FIGS. 12-13, an outer periphery of shoulder 23 includes an annular recess 231 having a bottom wall with a fourth diameter D4 perpendicular to the longitudinal axis of adapter 20, 20A. Fourth diameter D4 is smaller than third diameter D3 and larger than second diameter D2.

In the preferred forms shown in FIGS. 1-23, tool assembly 100 further includes a first C-clip 50 received in first retaining groove 33 of sleeve portion 30. First C-clip 50 has an inner diameter in an undistended state smaller than first and third diameters D1 and D3 and larger than second diameter D2. Furthermore, a difference between a diameter of first retaining groove 33 perpendicular to the longitudinal axis of body 10, 10A and first diameter D1 of head 41 is smaller than a difference between an outer diameter of first C-clip 50 and the inner diameter of first C-clip 50. First C-clip 50 includes first and second ends 51 and a retaining section 52 intermediate first and second ends 51 of first C-clip 50. In the preferred forms shown in FIGS. 1-23, each of first and second ends 51 of first C-clip 50 has a radius smaller than that of retaining section 52. First and second ends 51 of first C-clip 50 have decreasing spacings therebetween towards distal end portions thereof.

In the preferred forms shown in FIGS. 14-23, tool assembly 100 further includes a second C-clip 60 received in second retaining groove 34 of sleeve portion 30. Second C-clip 60 has an inner diameter in an undistended state smaller than first diameter D1 and larger than second diameter D2. Thus, second C-clip 60 can clamp the outer periphery of head 41 between first and second diameter D1 and D2. Second C-clip 60 has an outer diameter not larger than the diameter of second retaining groove 34.

Now that the basic construction of tool assembly 100 of the first embodiment according to the preferred teachings of the present invention has been explained, the operation and some of the advantages of tool assembly 100 can be set forth and appreciated. In particular, for the sake of explanation, it will be assumed that head 41 is the first position (see FIGS. 1, 3, 4, 11, and 12). In this position, shoulder 23 is received in receptacle 31 of sleeve portion 30, and first C-clip 50 distends and clamps the outer periphery of shoulder 23 to keep the longitudinal axis of adapter 20, 20A to be coaxial to the longitudinal axis of body 10, 10A. This is because the inner diameter of first C-clip 50 in the undistended state is smaller than third diameter D3. Thus, adapter 20, 20A and body 10, 10A can be coaxial to each other during joint rotation thereof. Note that the outer diameter of first C-clip 50 clamped around the outer periphery of shoulder 23 is within the extent of first retaining groove 33. In the preferred forms shown in FIGS. 1-23, first and second ends 51 of first C-clip 50 clamp around the outer periphery of shoulder 23, and retaining section 52 is received in first retaining groove 33. It can be appreciated that annular recess 231 receives first C-clip 50 in the preferred form shown in FIGS. 12-13.

Figure 5:
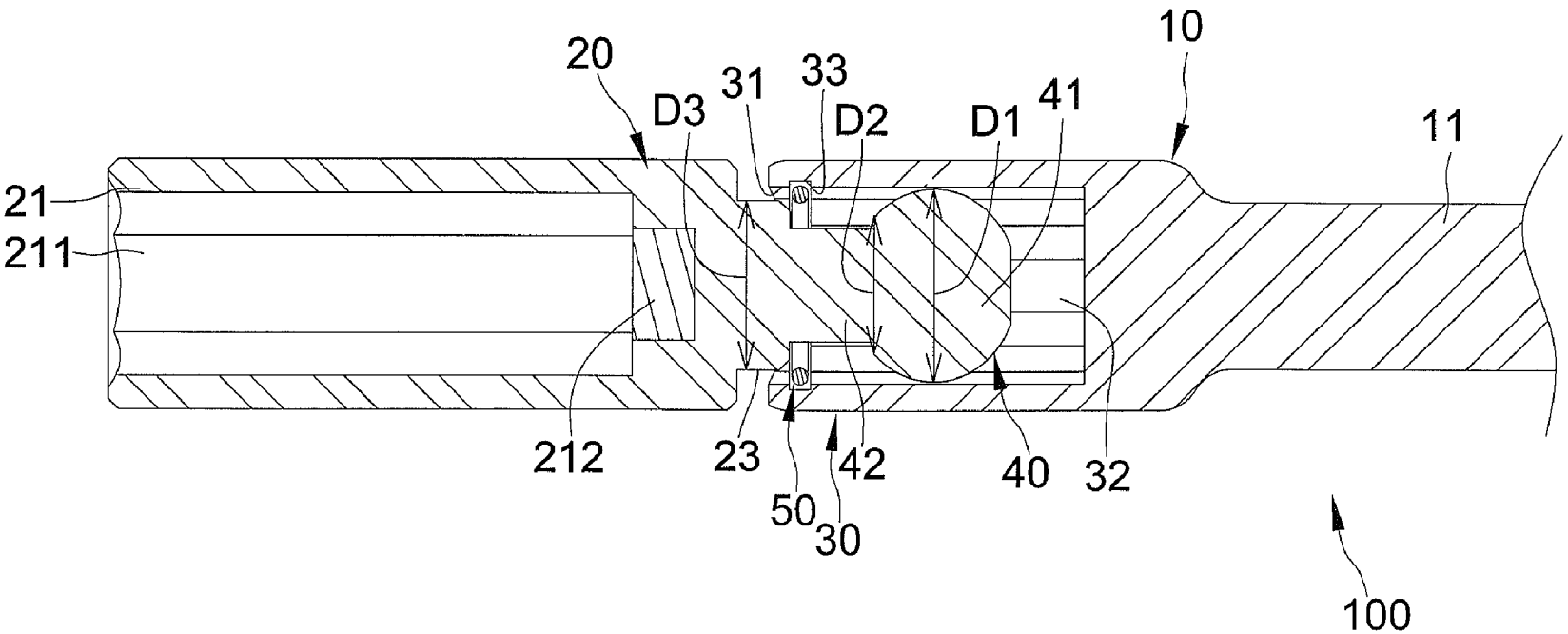
FIG. 5 shows a partial, cross sectional view of the tool assembly of FIG. 1 with the adapter moved away from the body.
Figure 6:
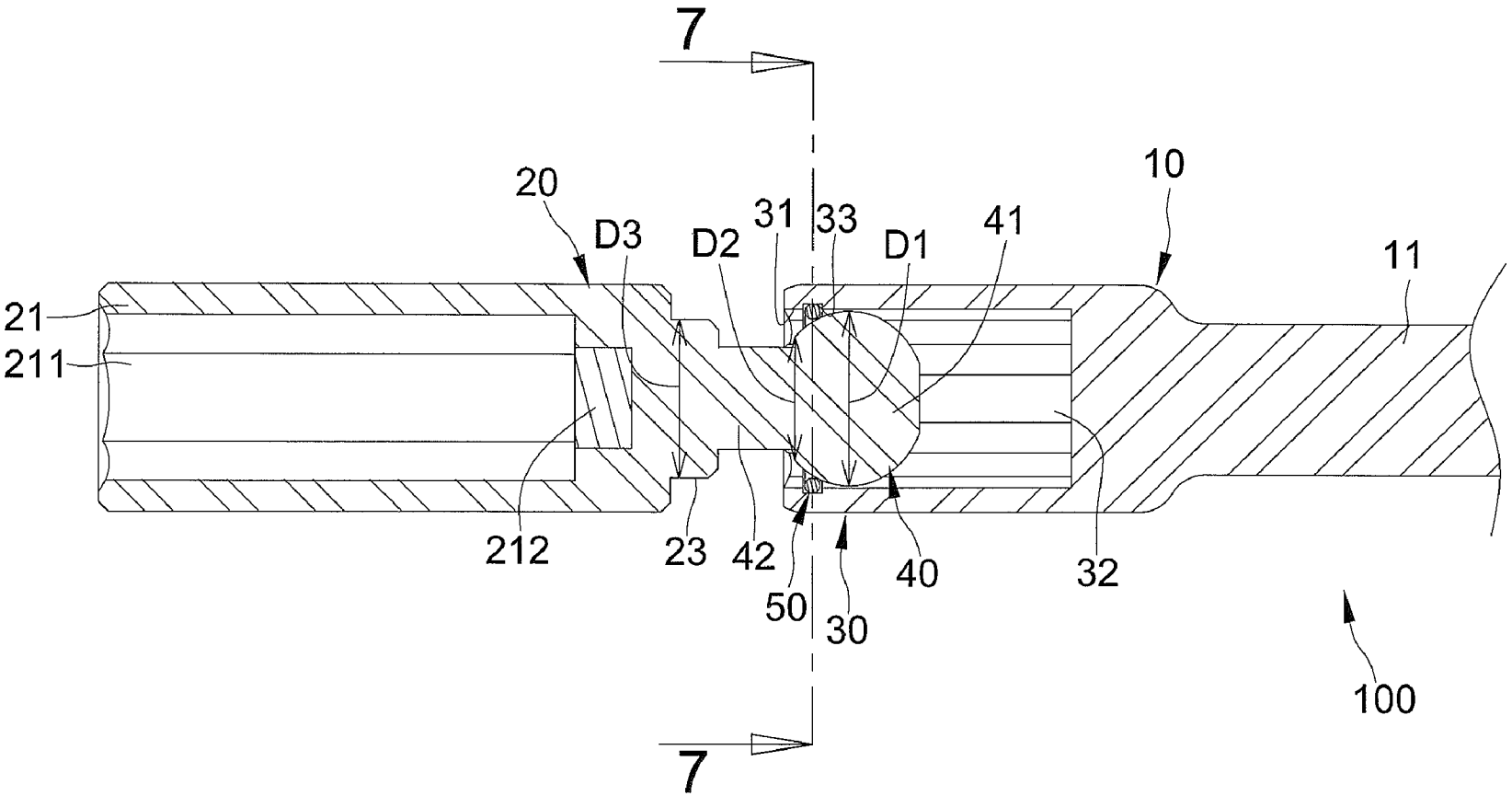
FIG. 6 shows a partial, cross sectional view of the tool assembly of FIG. 1 with the adapter moved further away from the body.
Figure 7:
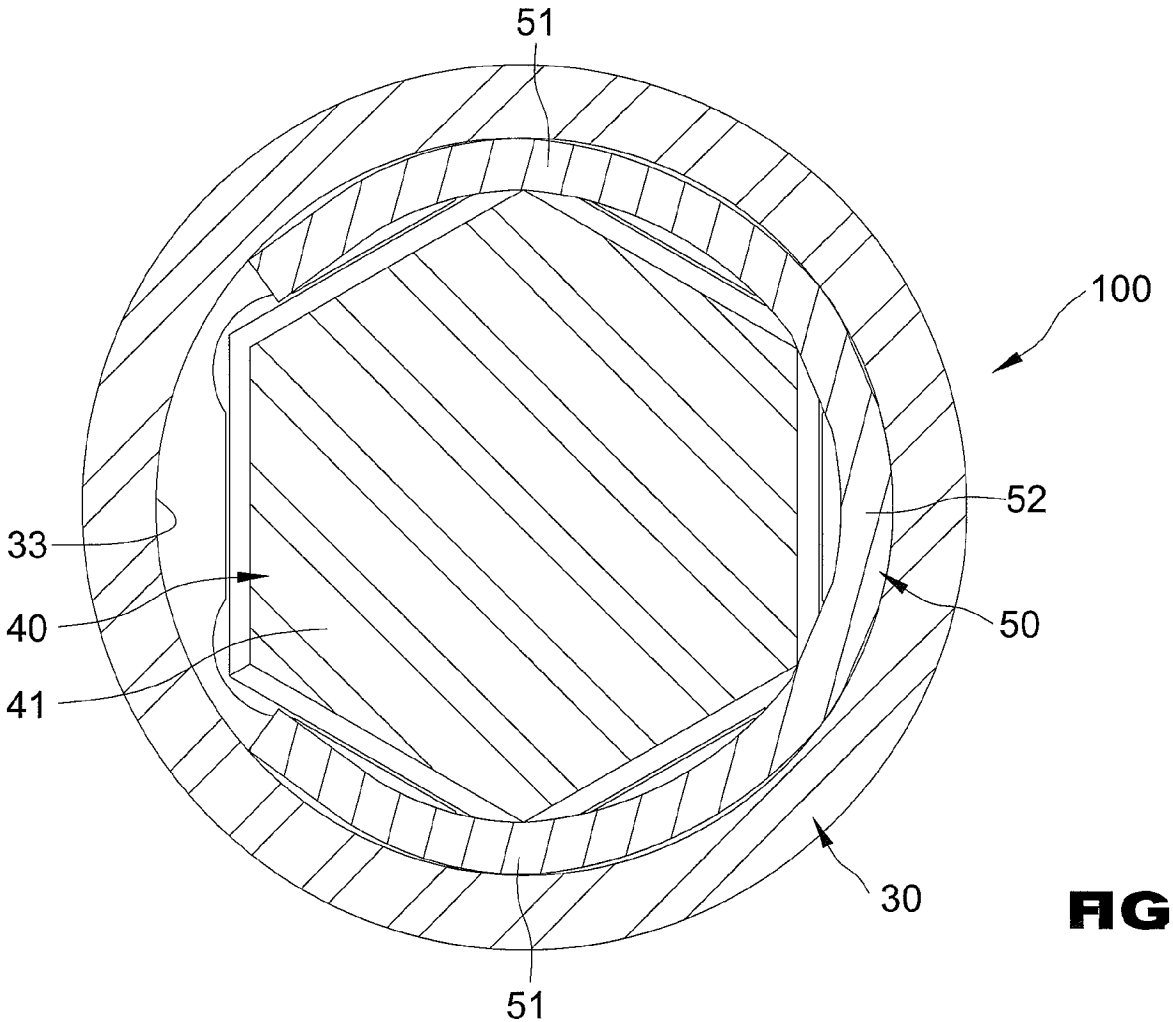
FIG. 7 shows a cross sectional view of the tool assembly of FIG. 1 according to section line 7-7 of FIG. 6.
Figure 8:
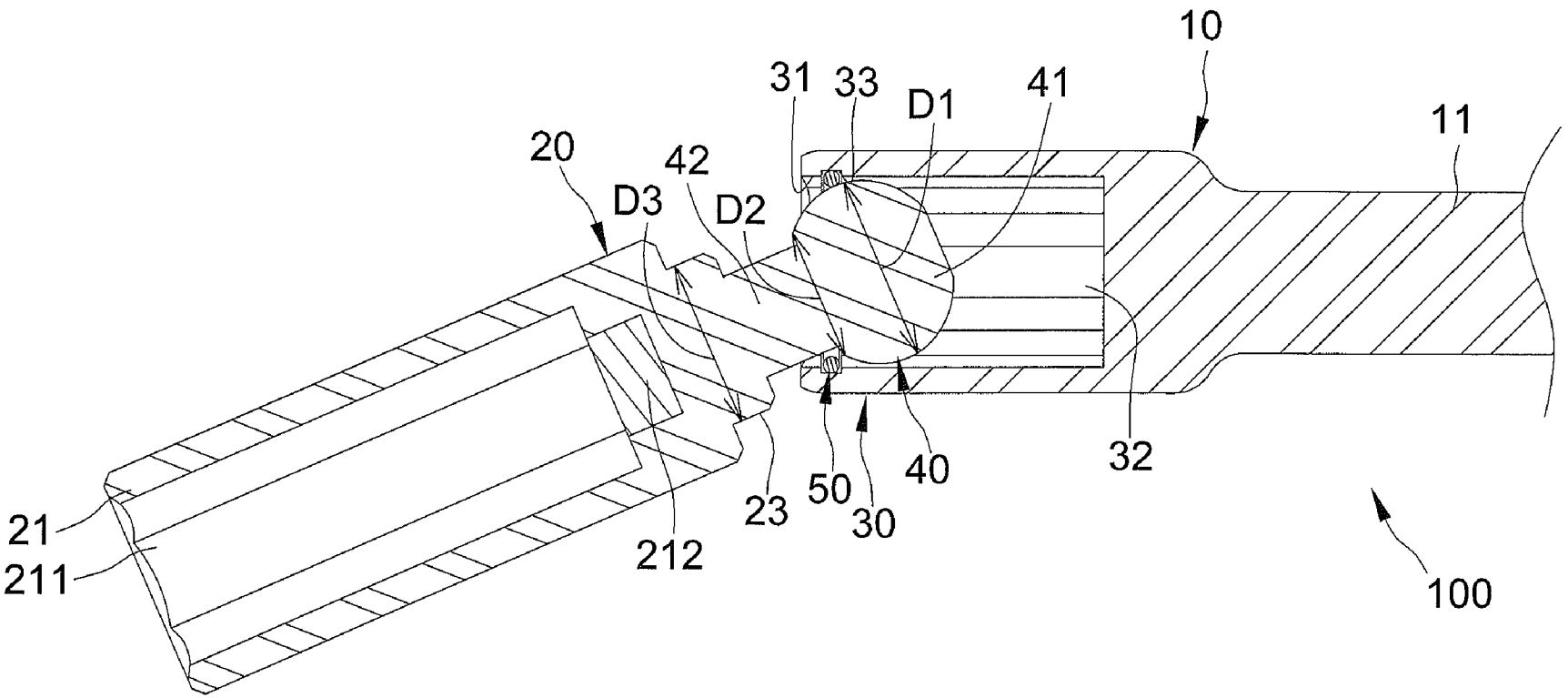
FIG. 8 shows a partial, cross sectional view of the tool assembly of FIG. 1 with the adapter at an acute angle to the body.
Figure 9:
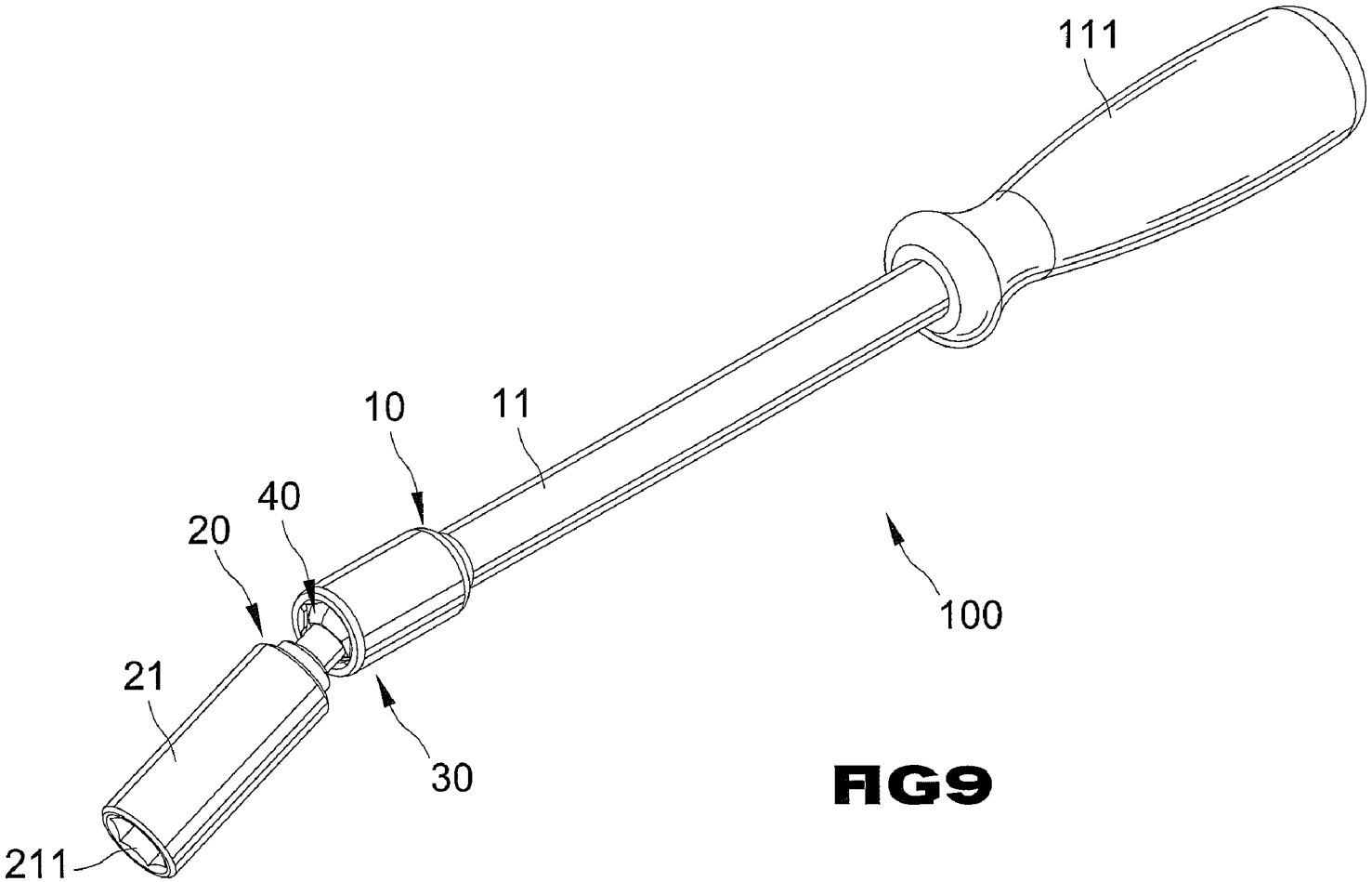
FIG. 9 shows a perspective view of the tool assembly of FIG. 1 with the adapter at an acute angle to the body.
Figure 10:
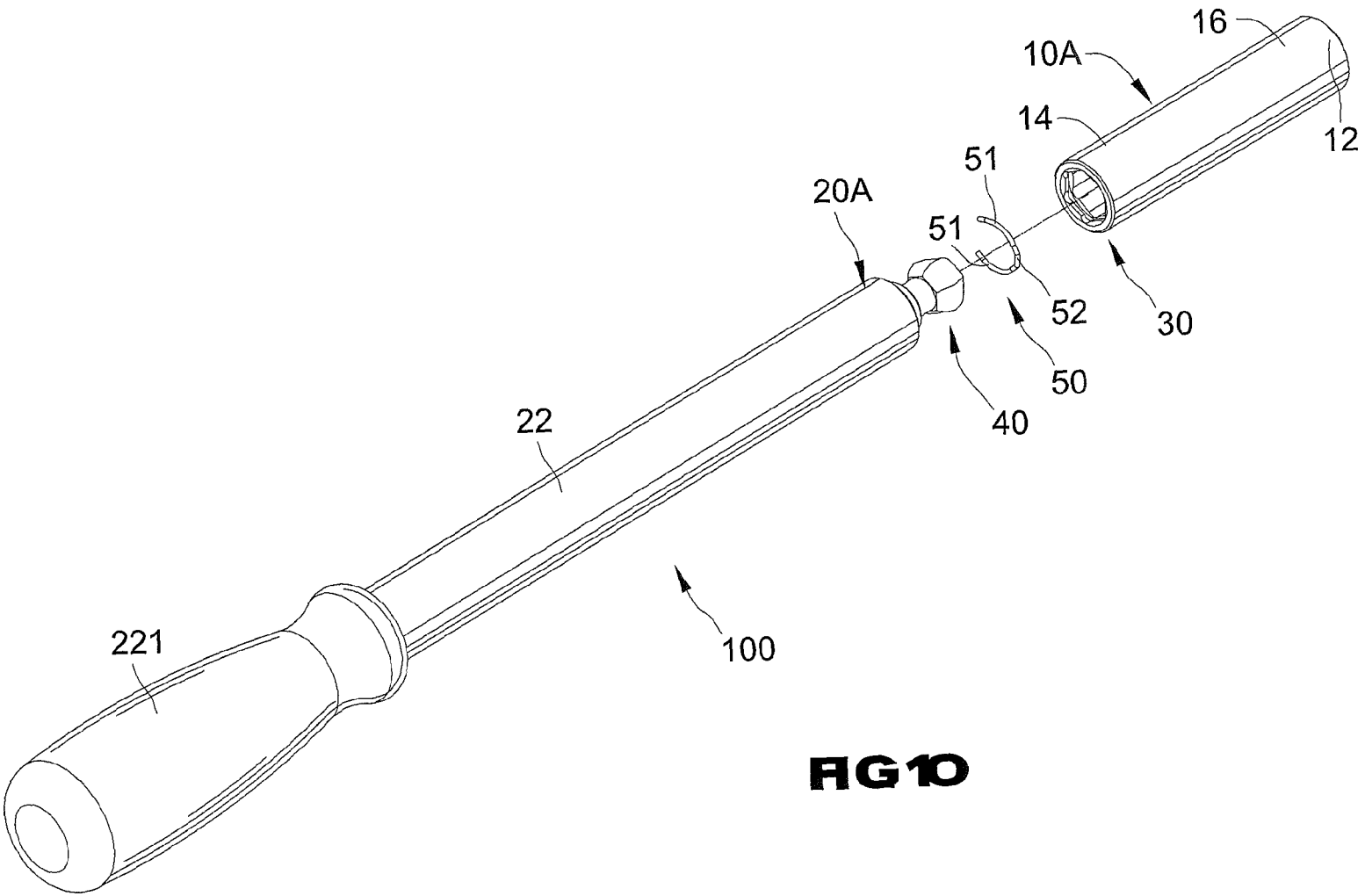
FIG. 10 shows an exploded, perspective view of a second example of the tool assembly of the first embodiment according to the preferred teachings of the present invention.
Figure 11:
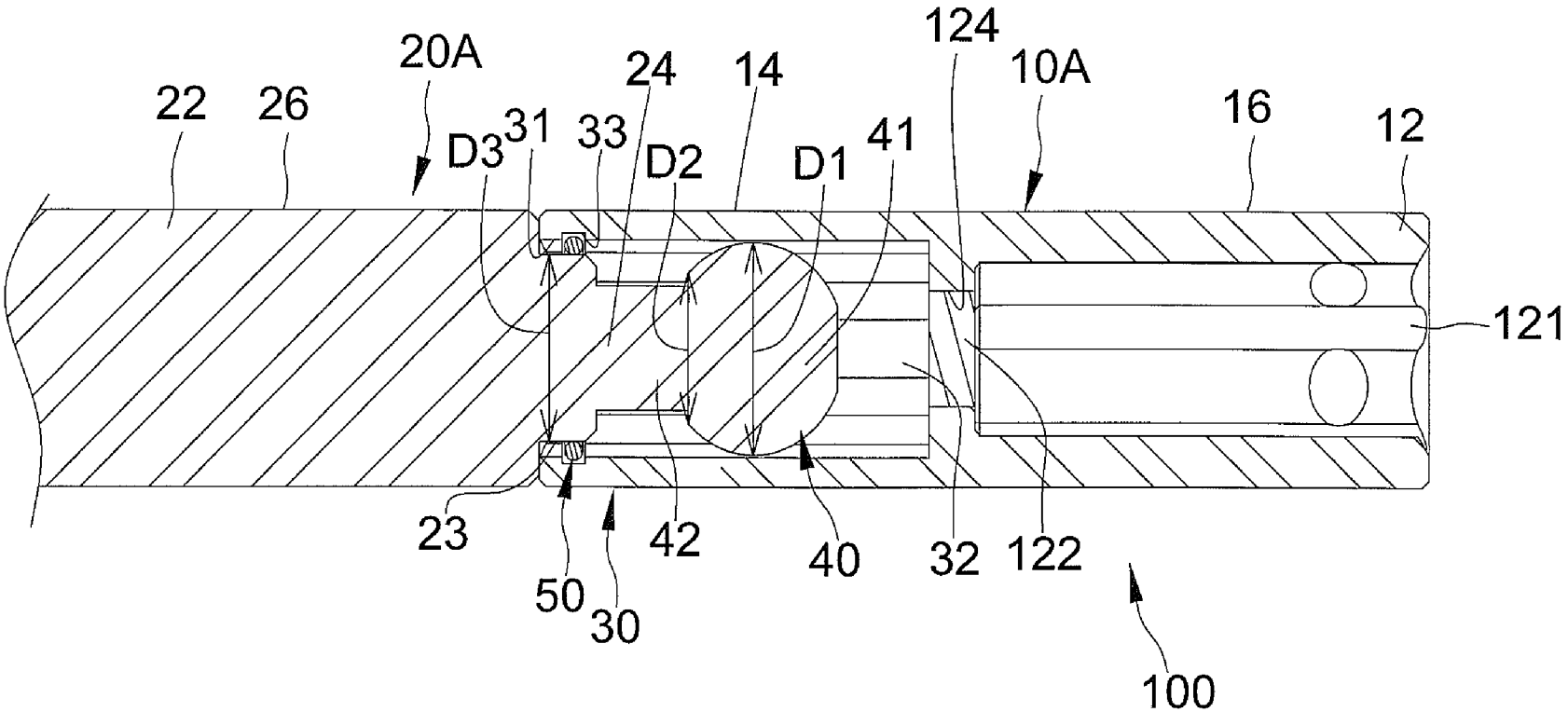
FIG. 11 shows a partial, cross sectional view of the tool assembly of FIG. 10.
Figure 12:
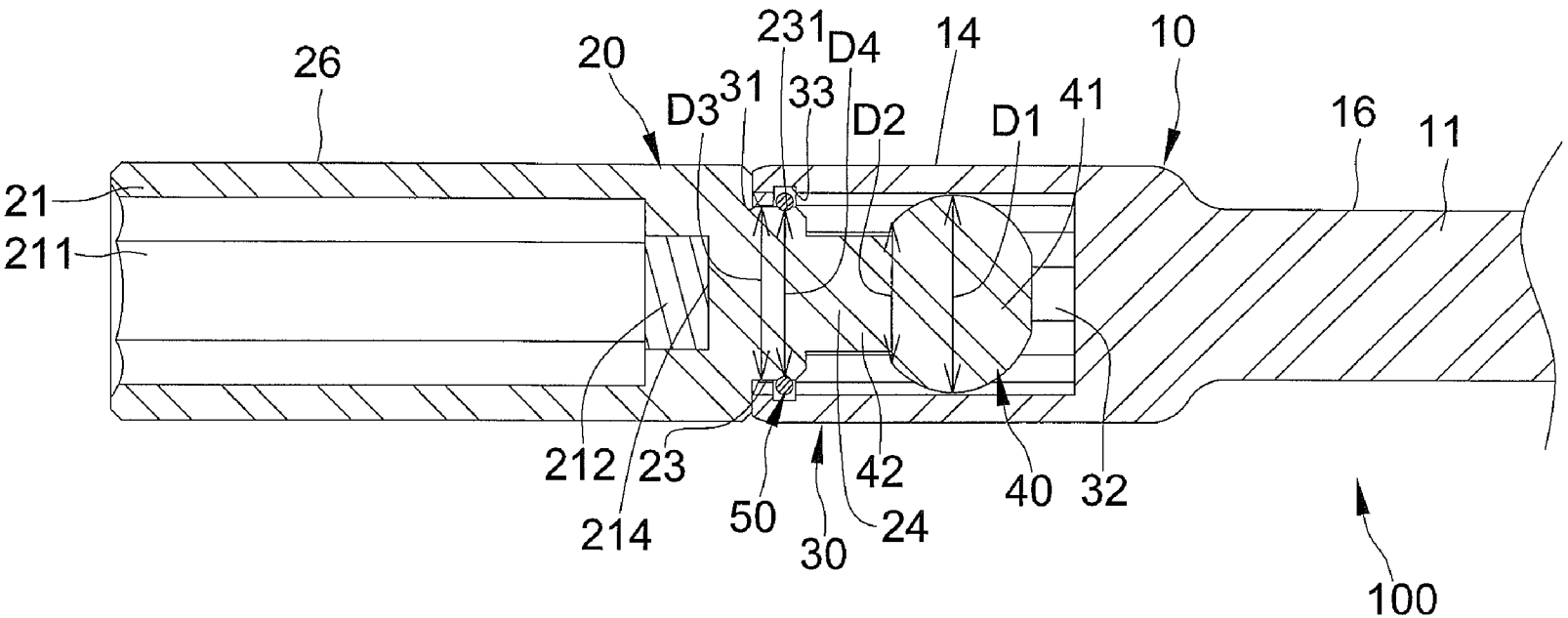
FIG. 12 shows a partial, cross sectional view of a third example of the tool assembly of the first embodiment according to the preferred teachings of the present invention.
Figure 13:
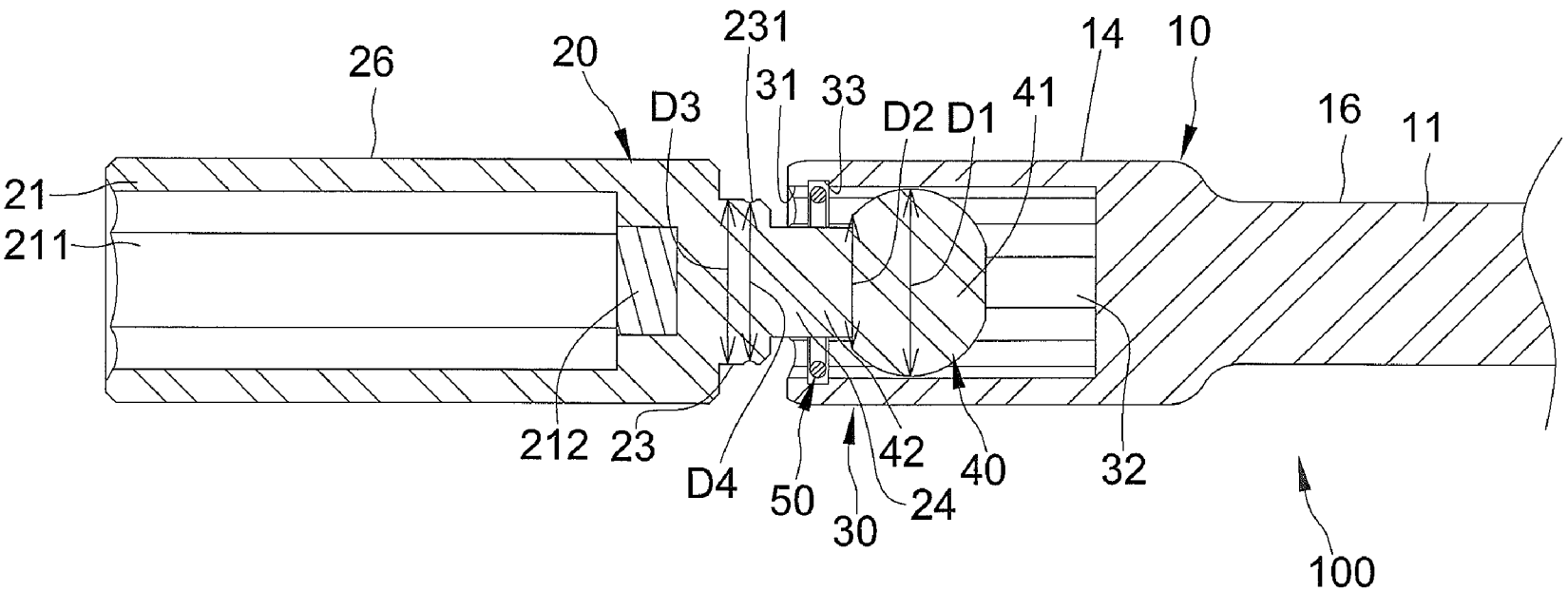
FIG. 13 shows a partial, cross sectional view of the tool assembly of FIG. 12 with an adapter moved away from a body of the tool assembly.
Figure 14:
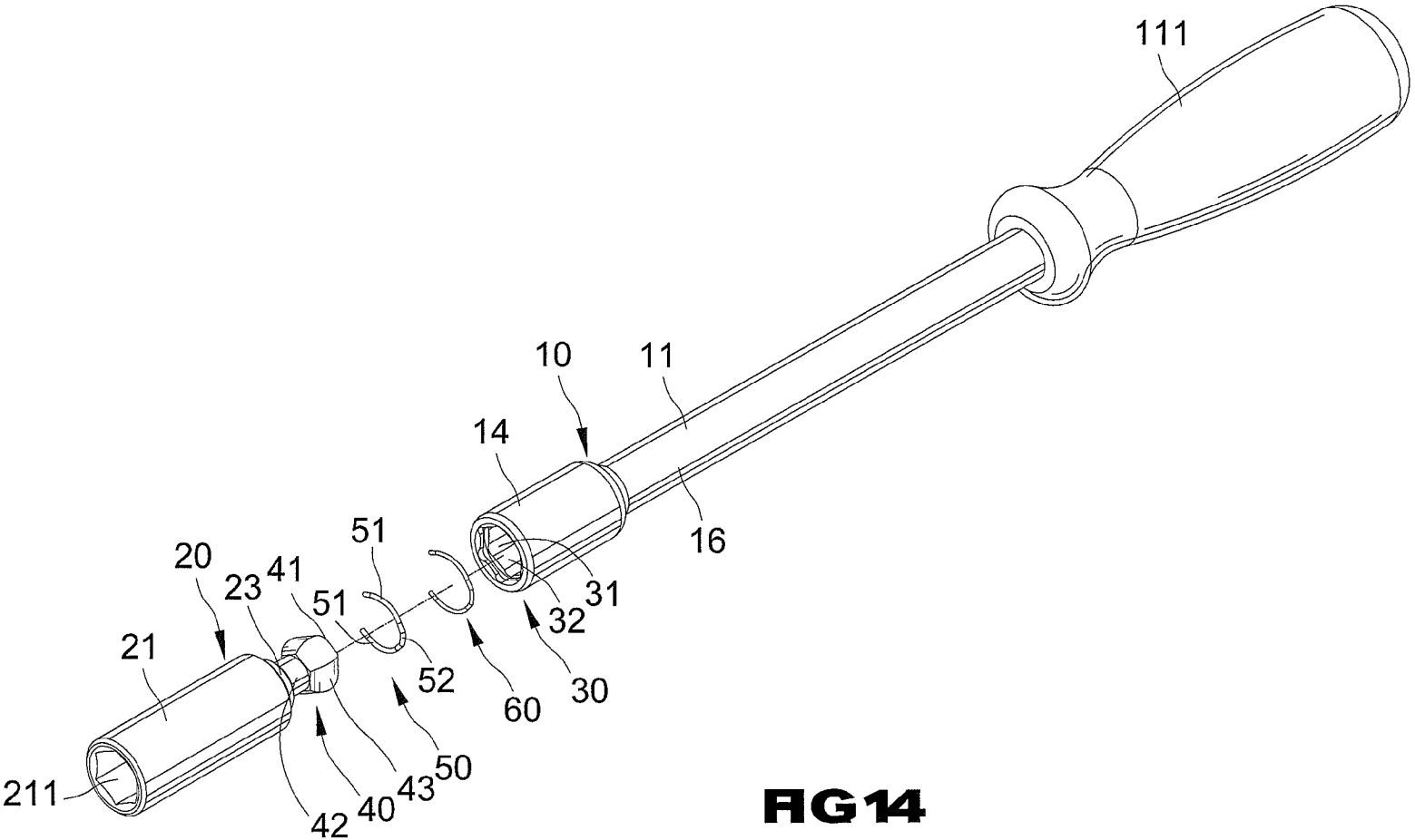
FIG. 14 shows an exploded, perspective view of a first example of a tool assembly of a second embodiment according to the preferred teachings of the present invention.
Figure 15:
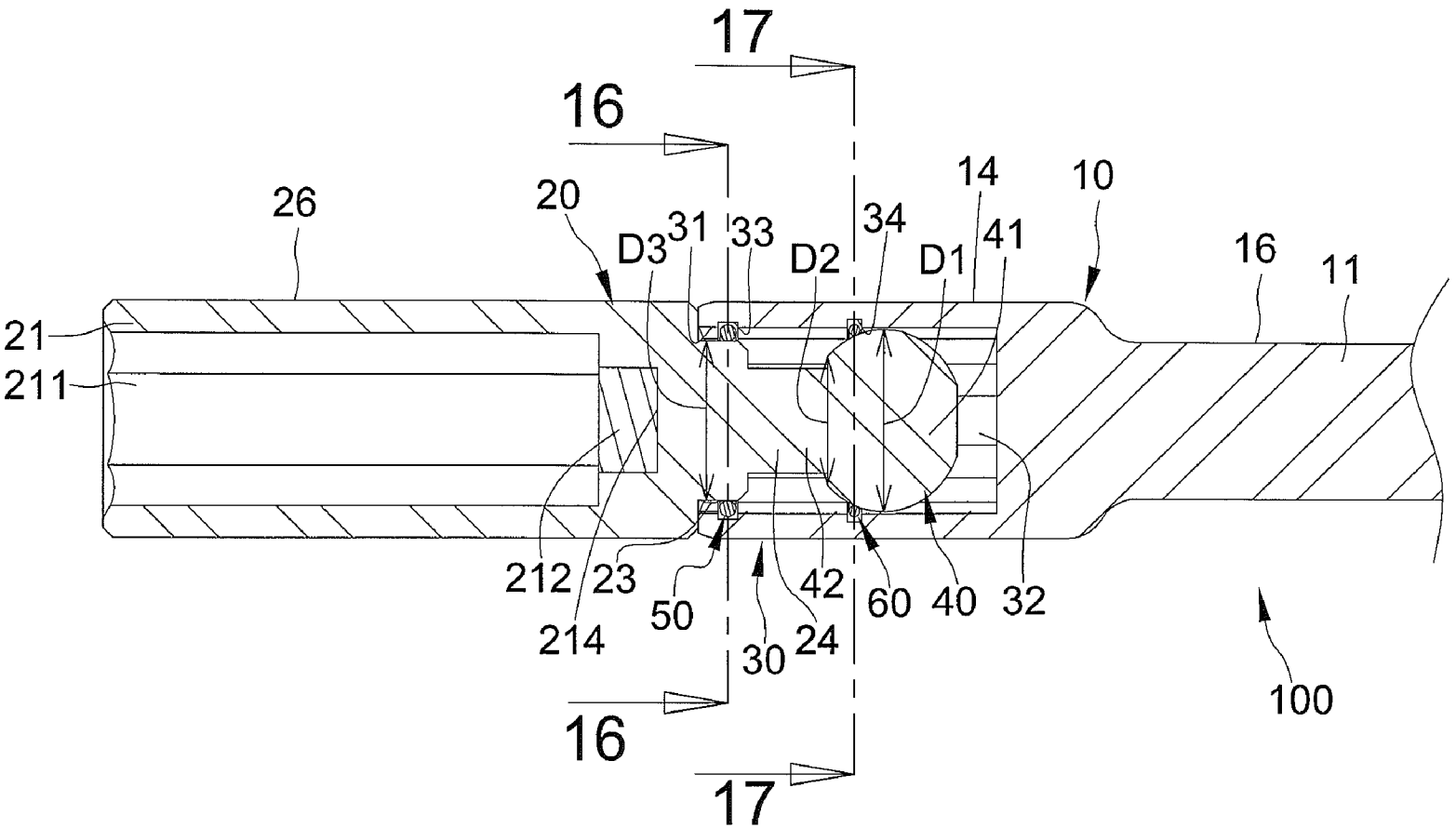
FIG. 15 shows a partial, cross sectional view of the tool assembly of FIG. 14 with an adapter coaxial to a body of the tool assembly.
Figure 16:
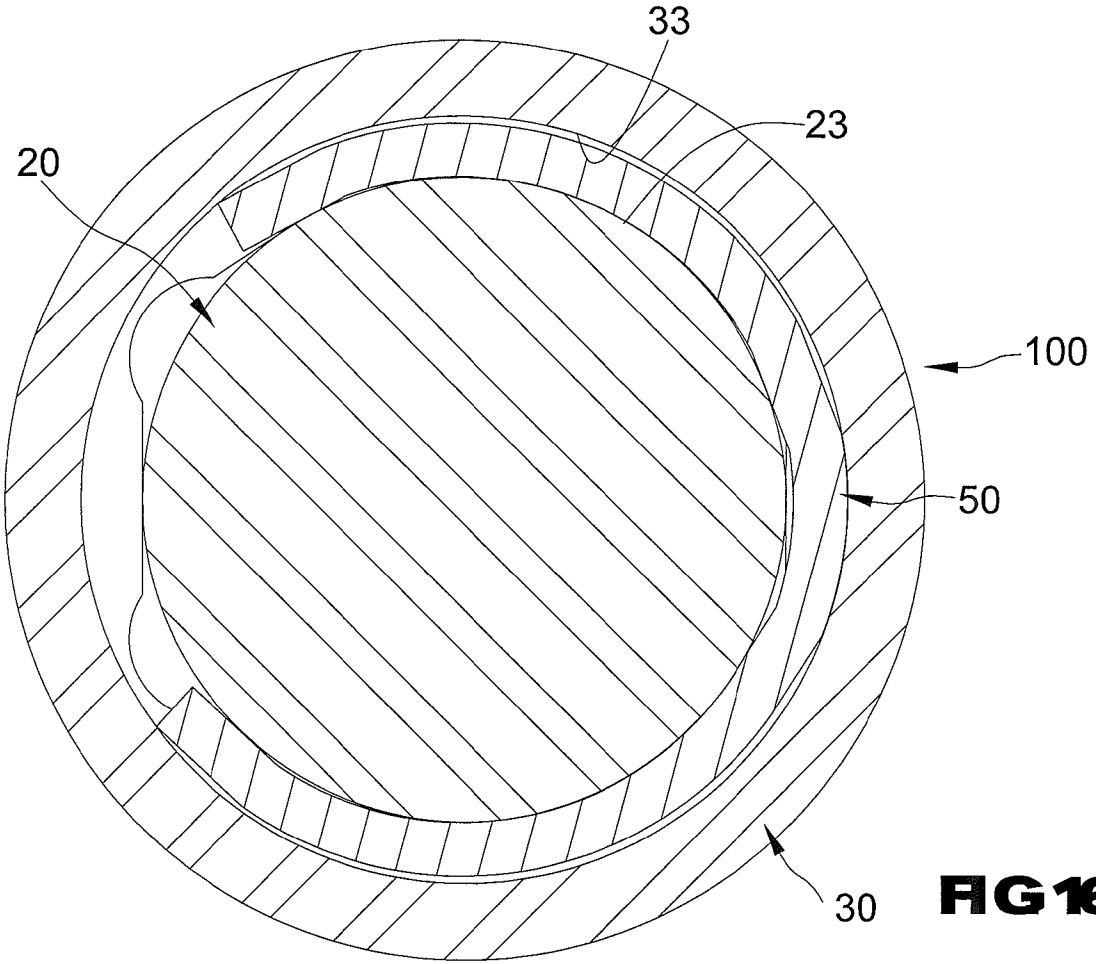
FIG. 16 shows a cross sectional view of the tool assembly of FIG. 14 according to section line 16-16 of FIG. 15.
Figure 17:
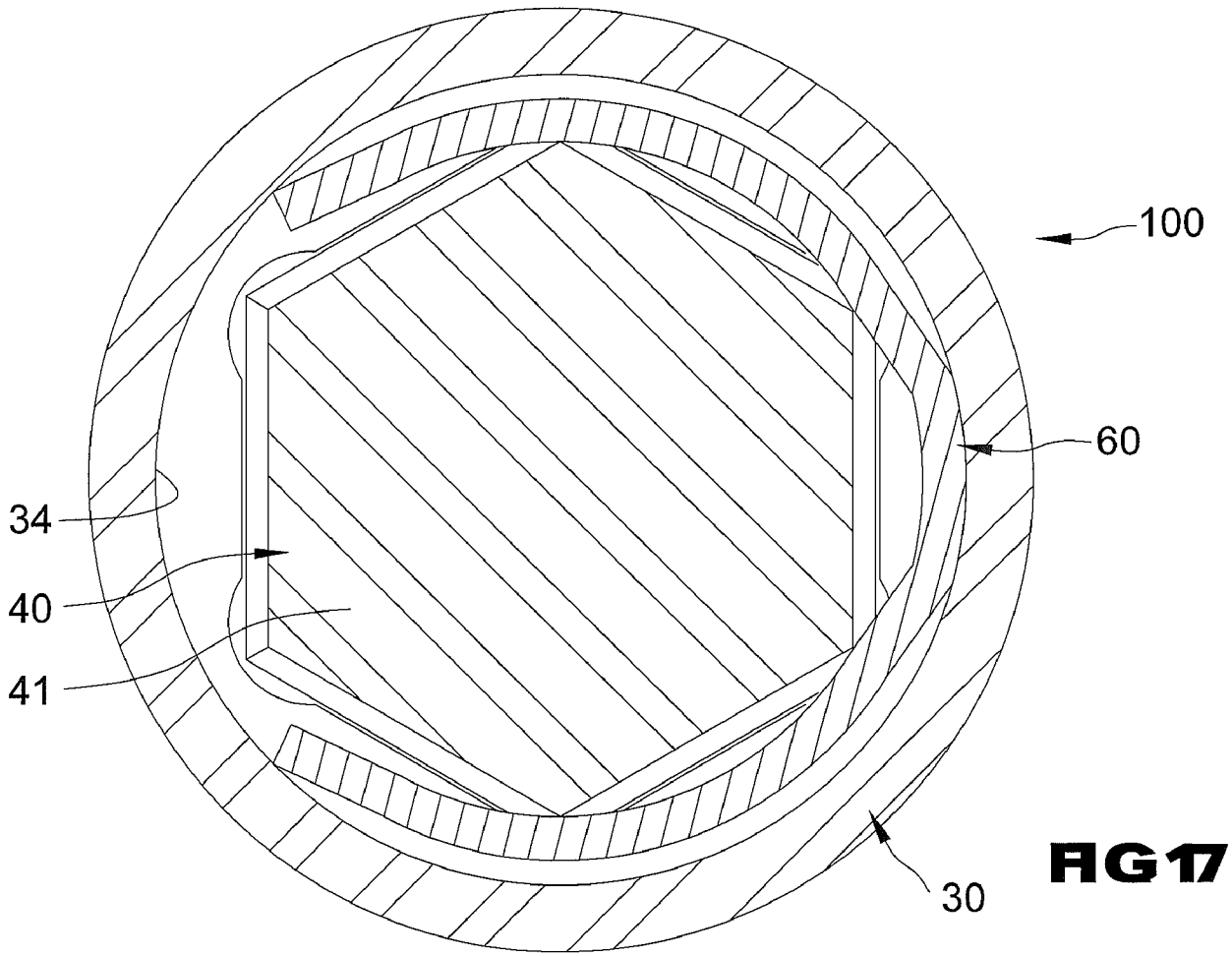
FIG. 17 shows a cross sectional view of the tool assembly of FIG. 14 according to section line 17-17 of FIG. 15.

Body 10, 10A and adapter 20, 20A can be moved away from each other along the longitudinal axis of body 10, 10A (or of adapter 20, 20A) such that shoulder 23 is no longer clamped by first C-clip 50 (FIGS. 5 and 13). Body 10, 10A and adapter 20, 20A can be moved away from each other until head 41 reaches the second position (FIGS. 6 and 7). In this position, shoulder 23 is outside of receptacle 31 of sleeve portion 30, and first C-clip 50 abuts the outer periphery of head 41. Since the difference between the diameter of first retaining groove 33 and first diameter D1 of head 41 is smaller than the difference between the outer diameter of first C-clip 50 and the inner diameter of first C-clip 50, the outer diameter of first C-clip 50 is limited by the diameter of first retaining groove 33 to prevent first diameter D1 of head 41 from passing through the inner diameter of first C-clip 50. Thus, first C-clip 50 prevents head 41 from disengaging from receptacle 31 of sleeve portion 30. Furthermore, head 41 is rotatable relative to the longitudinal axis of body 10, 10A to a position (see FIGS. 8 and 9) such that the longitudinal axis of adapter 20, 20A is at a desired acute angle to the longitudinal axis of body 10, 10A. Thus, adapter 20, 20A and body 10, 10A can have a desired acute angle therebetween during joint rotation thereof, which may be required in some situations. It can be appreciated that neck 42 allows a wide range of relative angular positions between body 10, 10A and adapter 20, 20A.

Operation and some of the advantages of tool assembly 100 of the second embodiment according to the preferred teachings of the present invention will now be set forth. In particular, for the sake of explanation, it will be assumed that head 41 is the first position (FIGS. 15-17 and 23). In this position, shoulder 23 is received in receptacle 31 of sleeve portion 30, and first C-clip 50 clamps the outer periphery of shoulder 23 to keep the longitudinal axis of adapter 20, 20A to be coaxial to the longitudinal axis of body 10, 10A. Note that the outer diameter of first C-clip 50 clamped around the outer periphery of shoulder 23 is not larger than the diameter of first retaining groove 33. Furthermore, second C-clip 60 clamps the outer periphery of head 41 between first and second diameter D1 and D2. It can be appreciated that first and second C-clips 50 and 60 securely clamp and, thus, retain adapter 20, 20A in coaxial relationship with body 10, 20A. Thus, adapter 20, 20A and body 10, 10A can be coaxial to each other during joint rotation thereof.

Figure 18:
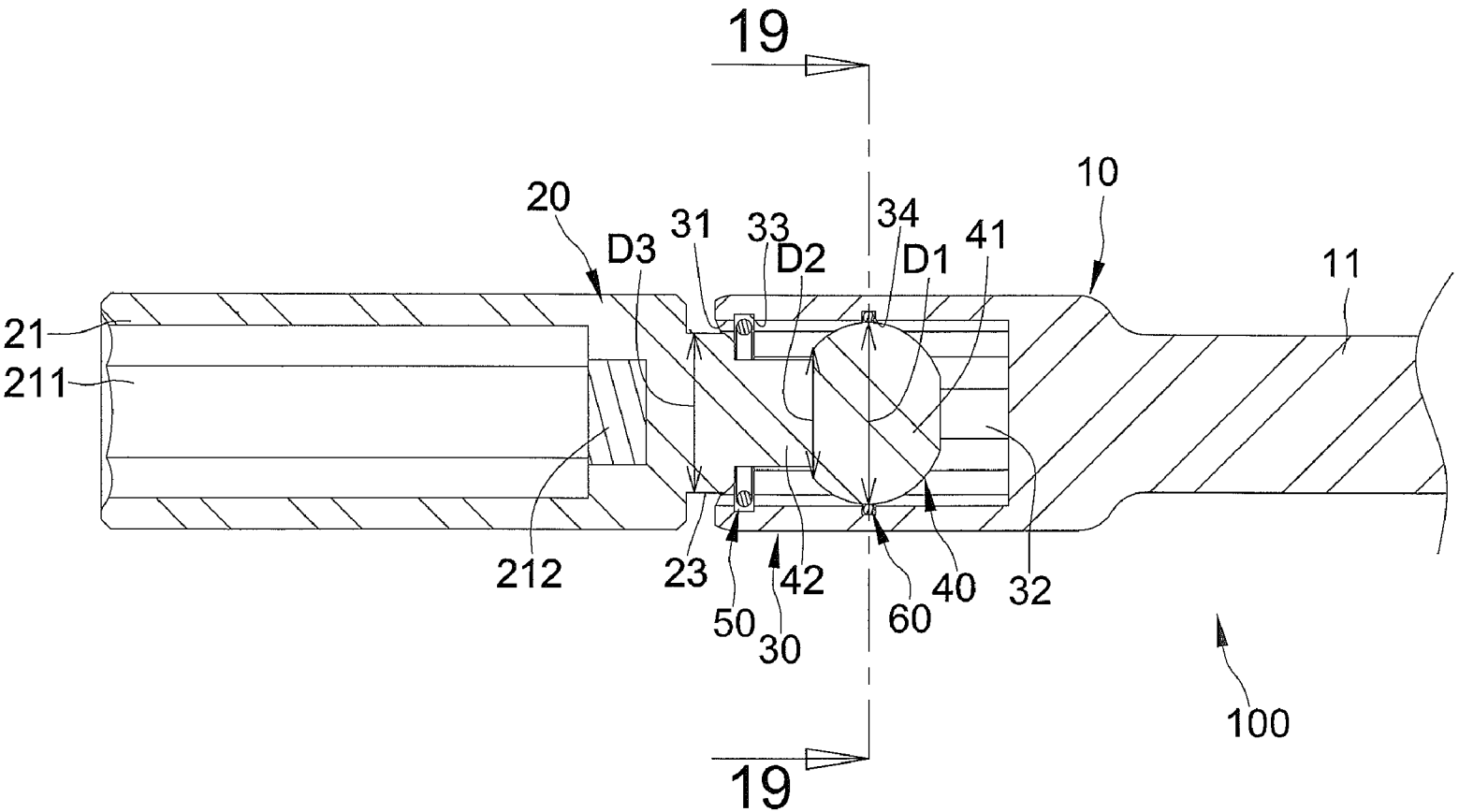
FIG. 18 shows a partial, cross sectional view of the tool assembly of FIG. 14 with the adapter moved away from the body.
Figure 19:
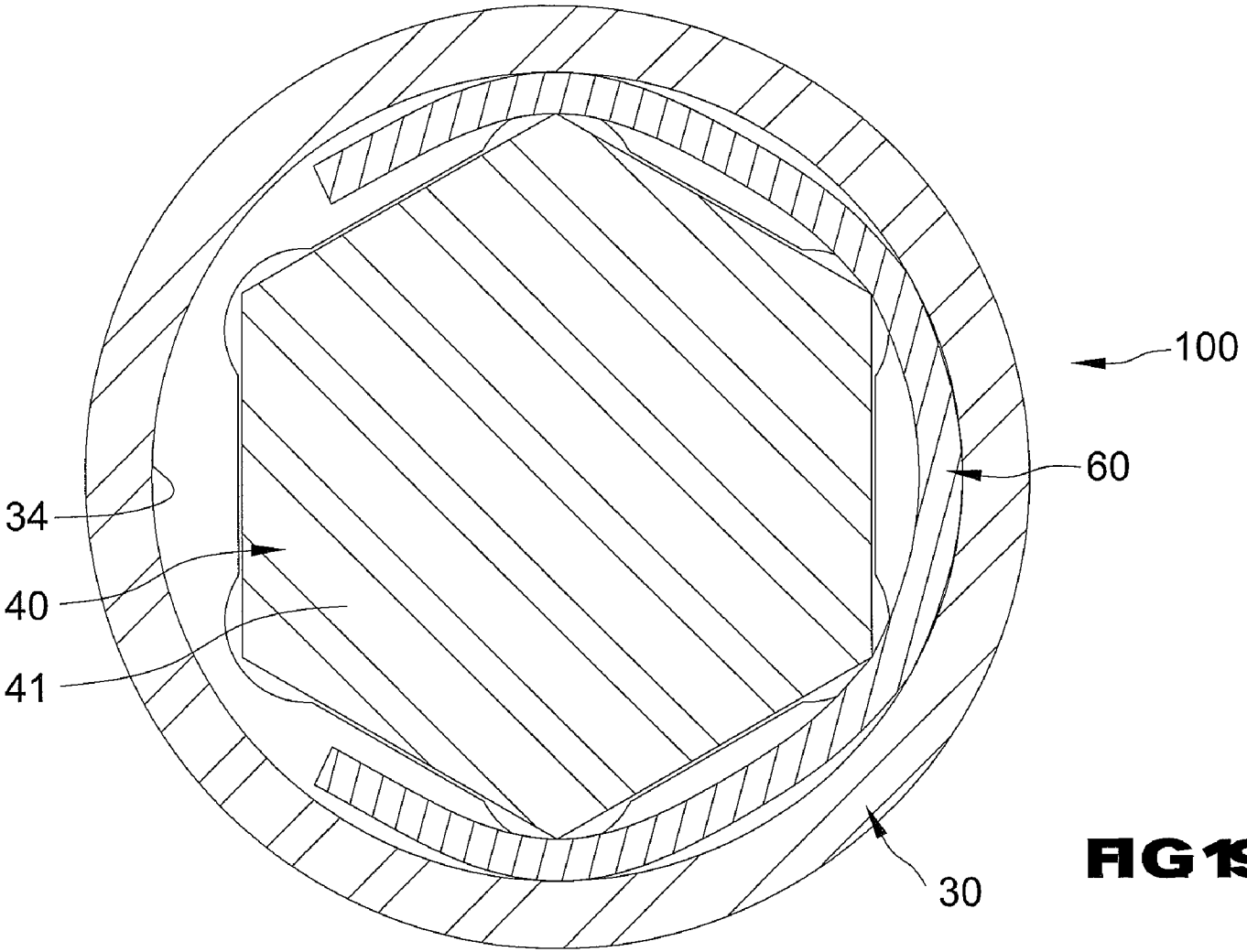
FIG. 19 shows a cross sectional view of the tool assembly of FIG. 14 according to section line 19-19 of FIG. 18.
Figure 20:
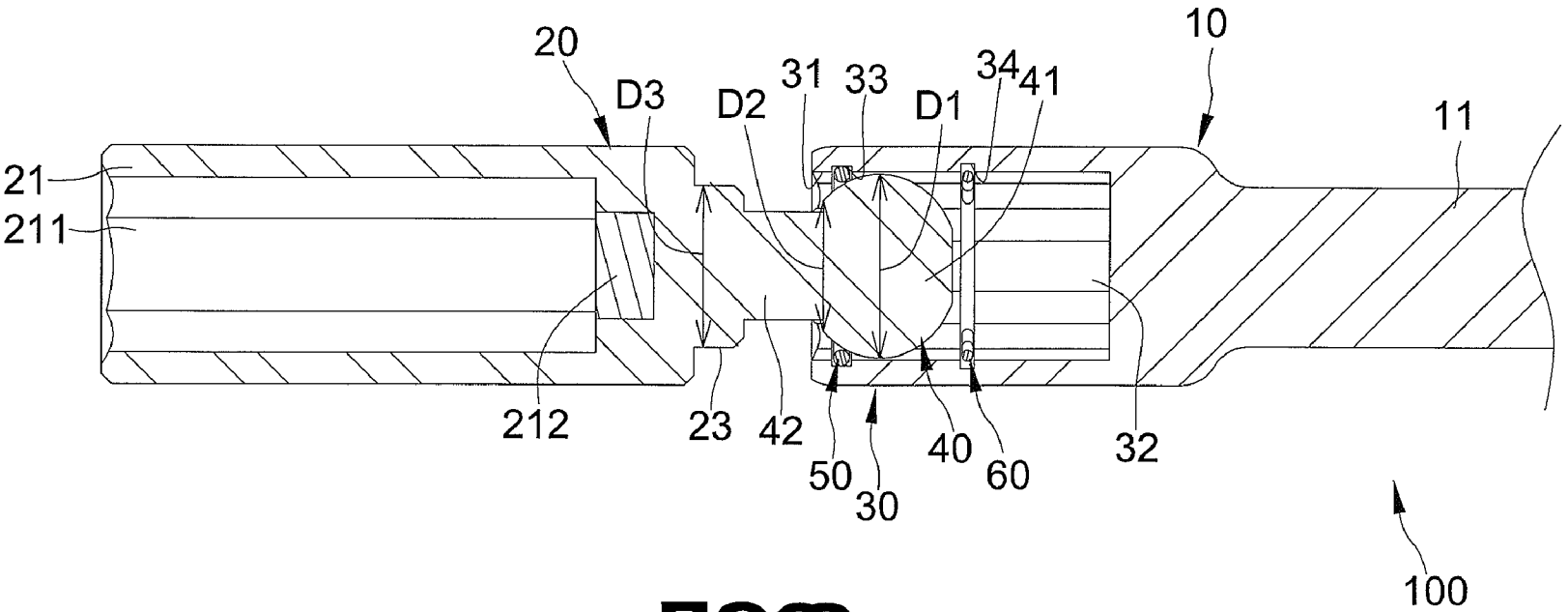
FIG. 20 shows a partial, cross sectional view of the tool assembly of FIG. 14 with the adapter moved further away from the body.
Figure 21:
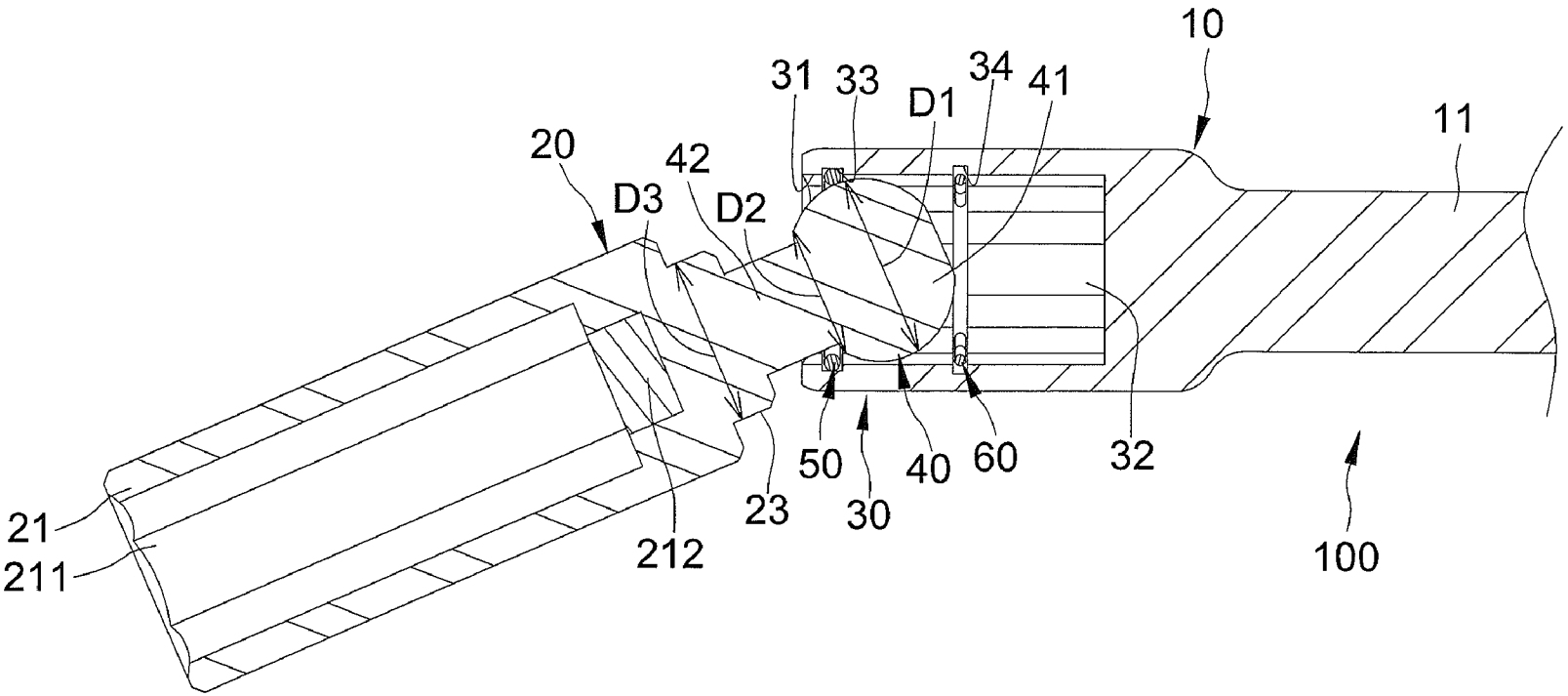
FIG. 21 shows a partial, cross sectional view of the tool assembly of FIG. 14 with the adapter at an acute angle to the body.
Figure 22:
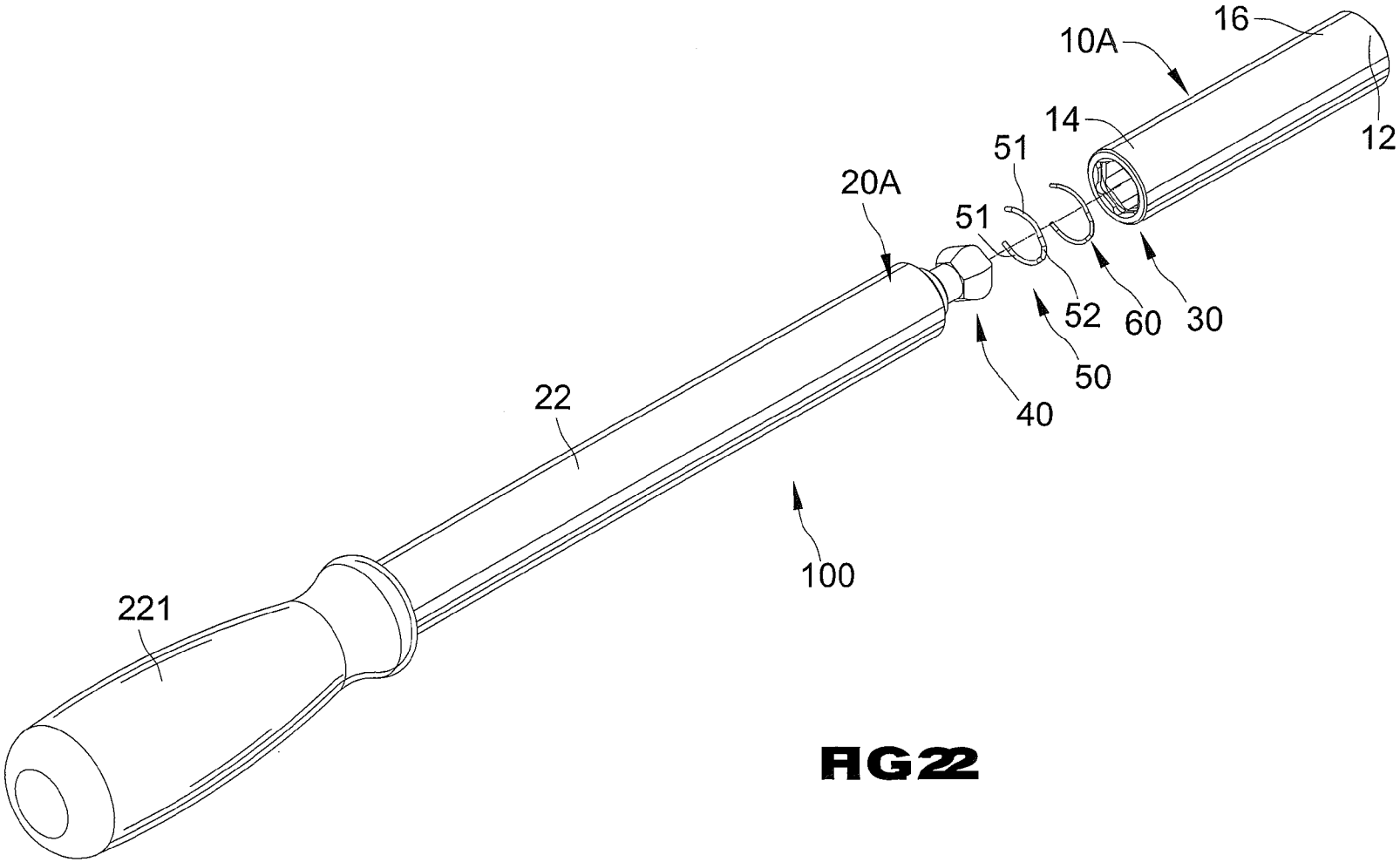
FIG. 22 shows an exploded, perspective view of a second example of the tool assembly of the second embodiment according to the preferred teachings of the present invention.
Figure 23:
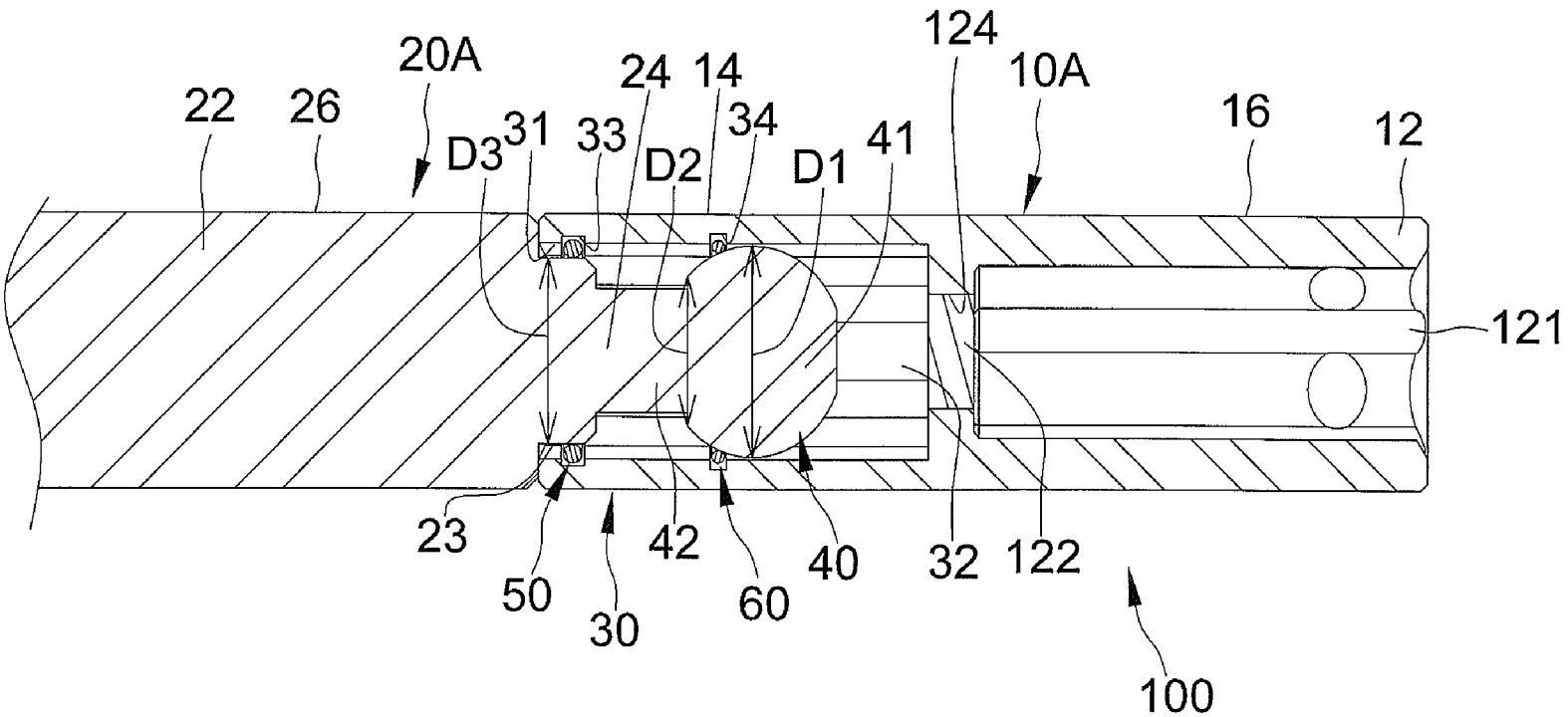
FIG. 23 shows a partial, cross sectional view of the tool assembly of FIG. 22.

Body 10, 10A and adapter 20, 20A can be moved away from each other along the longitudinal axis of body 10, 10A (or of adapter 20, 20A) such that shoulder 23 is no longer clamped by first C-clip 50 (FIGS. 18-19). Body 10, 10A and adapter 20, 20A can be moved away from each other until head 41 reaches the second position (FIG. 20). In this position, shoulder 23 is outside of receptacle 31 of sleeve portion 30, first C-clip 50 abuts the outer periphery of head 41, and head 41 disengages from second C-clip 60 received in second retaining groove 34. Since the difference between the diameter of first retaining groove 33 and first diameter D1 of head 41 is smaller than the difference between the outer diameter of first C-clip 50 and the inner diameter of first C-clip 50, the outer diameter of first C-clip 50 is limited by the diameter of first retaining groove 33 to prevent first diameter D1 of head 41 from passing through the inner diameter of first C-clip 50. Thus, first C-clip 50 prevents head 41 from disengaging from receptacle 31 of sleeve portion 30. Note that first diameter D1 of head 41 is intermediate first and second C-clips 50 and 60 along the longitudinal axis of body 10, 10A. Furthermore, head 41 is rotatable relative to the longitudinal axis of body 10, 10A to a position (FIG. 21) such that the longitudinal axis of adapter 20, 20A is at a desired acute angle to the longitudinal axis of body 10, 10A. Thus, adapter 20, 20A and body 10, 10A can have a desired acute angle therebetween during joint rotation thereof, which may be required in some situations. It can be appreciated that neck 42 allows a wide range of relative angular positions between body 10, 10A and adapter 20, 20A.

Thus, tool assembly 100 according to the preferred teachings of the present invention is simple in structure and easy to manufacture at low costs while allowing more reliable coaxial/universal coupling between body 10, 10A and adapter 20, 20A. Second C-clip 60 of the second embodiment shown in FIGS. 14-23 further enhances the retaining effect while adapter 20, 20A is coaxial to body 10, 10A.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A tool assembly comprising, in combination:

a body including first and second ends spaced along a longitudinal axis of the body, with the first end of the body including a sleeve portion having a receptacle with an opening in an end face of the first end, with the receptacle having non-circular cross sections perpendicular to the longitudinal axis of the body, with the receptacle further including an inner periphery having an annular first retaining groove adjacent the opening of the receptacle;

an adapter including first and second ends spaced along a longitudinal axis of the adapter, with a shoulder formed on the first end of the adapter and having an outer periphery, with the first end of the adapter further including a head and a neck, with the neck interconnecting and intermediate the head and the shoulder along the longitudinal axis of the adapter, with the head having non-circular cross sections perpendicular to the longitudinal axis of the adapter, with the head engaged with the inner periphery of the receptacle to allow joint rotation of the adapter and the body, with the head slideably received in the receptacle of the sleeve portion along the longitudinal axis of the body between first and second positions; and a first C-clip received in the first retaining groove of the sleeve portion, with the first C-clip preventing the head from disengaging from the receptacle, wherein when the head is in the first position, the shoulder is received in the receptacle of the sleeve portion, the first C-clip distends and clamps the outer periphery of the shoulder to keep the longitudinal axis of the adapter to be coaxial to the longitudinal axis of the body, and wherein when the head is in the second position, the shoulder is outside of the receptacle of the sleeve portion, the first C-clip abuts an outer periphery of the head, the head is rotatable relative to the longitudinal axis of the body to a position such that the longitudinal axis of the adapter is at an angle to the longitudinal axis of the body.

2. The tool assembly as claimed in claim 1, with the head having a maximum, first diameter perpendicular to the longitudinal axis of the adapter, with the head further having a second diameter perpendicular to the longitudinal axis of the adapter at an adjoining section contiguous to the neck, with the shoulder having a third diameter perpendicular to the longitudinal axis of the adapter, with the first diameter larger than the third diameter, with the third diameter larger than the second diameter, with the first C-clip having an inner diameter in an undistended state smaller than the third diameter, and with an outer diameter of the first C-clip clamped around the outer periphery of the shoulder being not larger than a diameter of the first retaining groove perpendicular to the longitudinal axis of the body.

3. The tool assembly as claimed in claim 2, with the shoulder having circular cross sections perpendicular to the longitudinal axis of the adapter.

4. The tool assembly as claimed in claim 2, with a difference between the diameter of the first retaining groove and the first diameter of the head being smaller than a difference between the outer diameter of the first C-clip and the inner diameter of the first C-clip.

5. The tool assembly as claimed in claim 4, with the outer periphery of the shoulder including an annular recess having a bottom wall with a fourth diameter perpendicular to the longitudinal axis of the adapter, with the fourth diameter smaller than the third diameter and larger than the second diameter, with the annular recess receiving the first C-clip when the head is in the first position.

6. The tool assembly as claimed in claim 2, with the first C-clip including first and second ends and a retaining section intermediate the first and second ends of the first C-clip, with each of the first and second ends of the first C-clip having a radius smaller than that of the retaining section, with the first and second ends of the first C-clip having decreasing spacings therebetween towards distal end portions thereof, with the first and second ends of the first C-clip clamping around the outer periphery of the shoulder and with the retaining section received in the first retaining groove when the head is in the first position.

7. The tool assembly as claimed in claim 1, with a shank formed on the second end of the body, with the second end of the adapter including a driving section having an engaging groove, and with the engaging groove adapted to releasably receive a bit.

8. The tool assembly as claimed in claim 7, with the engaging groove having an end wall, with the end wall having a receiving space, with the tool assembly further comprising, in combination: a magnet received in the receiving space, with the magnet adapted to attract the bit received in the engaging groove.

9. The tool assembly as claimed in claim 1, with a shank formed on the second end of the adapter, with the second end of the body including a driving section having an engaging groove, with the engaging groove adapted to releasably receive a bit.

10. The tool assembly as claimed in claim 9, with the engaging groove having an end wall, with the end wall having a receiving space, with the tool assembly further comprising, in combination: a magnet received in the receiving space, with the magnet adapted to attract the bit received in the engaging groove.

11. The tool assembly as claimed in claim 1, with the inner periphery of the receptacle of the sleeve portion including at least one planar engaging surface, with the outer periphery of the head including at least one arcuate planar engaging face aligned with said at least one planar engaging surface, with at least one planar engaging surface of the sleeve portion engaged with said at least one engaging face of the head to allow joint rotation of the body and the adapter.

12. The tool assembly as claimed in claim 11, the receptacle having hexagonal cross sections perpendicular to the longitudinal axis of the body, and with the head having hexagonal cross sections perpendicular to the longitudinal axis of the adapter.

13. The tool assembly as claimed in claim 1, with the inner periphery of the receptacle further including an annular second retaining groove, with the first retaining groove intermediate the second retaining groove and the opening of the receptacle along the longitudinal axis of the body, with the tool assembly further comprising, in combination: a second C-clip received in the second retaining groove of the sleeve portion, wherein when the head is in the first position, the second C-clip distends and clamps an outer periphery of the head to keep the longitudinal axis of the adapter to be coaxial to the longitudinal axis of the body, and wherein when the head is in the second position, the head is disengaged from the second C-clip.

14. The tool assembly as claimed in claim 13, with the head having a maximum, first diameter perpendicular to the longitudinal axis of the adapter, with the head further having a second diameter perpendicular to the longitudinal axis of the adapter at an adjoining section contiguous to the neck, with the shoulder having a third diameter perpendicular to the longitudinal axis of the adapter, with the first diameter larger than the third diameter, with the third diameter larger than the second diameter, with the first C-clip having an inner diameter in an undistended state smaller than the third diameter, and with an outer diameter of the first C-clip clamped around the outer periphery of the shoulder being not larger than a diameter of the first retaining groove perpendicular to the longitudinal axis of the body.

15. The tool assembly as claimed in claim 14, with the second retaining groove having a diameter perpendicular to the longitudinal axis of the body and larger than the diameter of the first retaining groove, with the second C-clip having an inner diameter in the undistended state smaller than the first diameter and larger than the second diameter, with the second C-clip clamping the head between the first and second diameters of the head along the longitudinal axis of the body when the head is in the first position.

16. The tool assembly as claimed in claim 15, with the first diameter of the head intermediate the first and second C-clips along the longitudinal axis of the body when the head is in the second position.

17. The tool assembly as claimed in claim 16, with a difference between the diameter of the first retaining groove and the first diameter of the head being smaller than a difference between the outer diameter of the first C-clip and the inner diameter of the first C-clip.

18. The tool assembly as claimed in claim 17, with a shank formed on the second end of the body, with the second end of the adapter including a driving section having an engaging groove, and with the engaging groove adapted to releasably receive a bit, with the engaging groove having an end wall, with the end wall having a receiving space, with the tool assembly further comprising, in combination: a magnet received in the receiving space, with the magnet adapted to attract the bit received in the engaging groove.

19. The tool assembly as claimed in claim 17, with a shank formed on the second end of the adapter, with the second end of the body including a driving section having an engaging groove, with the engaging groove adapted to releasably receive a bit, with the engaging groove having an end wall, with the end wall having a receiving space, with the tool assembly further comprising, in combination: a magnet received in the receiving space, with the magnet adapted to attract the bit received in the engaging groove.

20. The tool assembly as claimed in claim 13, with the inner periphery of the receptacle of the sleeve portion including at least one planar engaging surface, with the outer periphery of the head including at least one arcuate planar engaging face aligned with said at least one planar engaging surface, with at least one planar engaging surface of the sleeve portion engaged with said at least one engaging face of the head to allow joint rotation of the body and the adapter, with the receptacle having hexagonal cross sections perpendicular to the longitudinal axis of the body, and with the head having hexagonal cross sections perpendicular to the longitudinal axis of the adapter.

* * * * *